US010370864B2

(12) United States Patent
Gavin

(10) Patent No.: US 10,370,864 B2
(45) Date of Patent: Aug. 6, 2019

(54) SPA COVER LIFTER SYSTEM AND METHOD

(71) Applicant: Carl Gavin, Ferndale, WA (US)

(72) Inventor: Carl Gavin, Ferndale, WA (US)

(73) Assignee: Carl Gavin, Ferndale, WA (US)

( * ) Notice: Subject to any disclaimer, the term of this patent is extended or adjusted under 35 U.S.C. 154(b) by 4 days.

(21) Appl. No.: 15/475,231

(22) Filed: Mar. 31, 2017

(65) Prior Publication Data

US 2017/0284114 A1 Oct. 5, 2017

Related U.S. Application Data

(63) Continuation of application No. 62/316,471, filed on Mar. 31, 2016.

(51) Int. Cl.
*E04H 4/08* (2006.01)

(52) U.S. Cl.
CPC ..... *E04H 4/084* (2013.01)

(58) Field of Classification Search
CPC ..... E04H 4/08; E04H 4/082; E04H 4/084; E04H 4/086; E04H 4/088; E04H 4/10–4/108
USPC ..... 4/498, 500, 503, 504
See application file for complete search history.

(56) References Cited

U.S. PATENT DOCUMENTS 4,857,374 A * 8/1989 Perry ..... E04H 4/084 428/71
5,566,403 A * 10/1996 Black ..... E04H 4/084 220/264
6,442,799 B1 * 9/2002 Duarte ..... E04H 4/084 16/277
7,146,656 B2 * 12/2006 Hagan ..... E04H 4/084 4/498
7,752,685 B2 * 7/2010 Tudor ..... E04H 4/084 4/498
7,971,287 B2 * 7/2011 Buzzetti ..... E04H 4/084 4/498
2002/0050003 A1 * 5/2002 Perry ..... E04H 4/084 4/498
2004/0034915 A1 * 2/2004 Tedrick ..... E04H 4/084 4/498
2005/0132486 A1 * 6/2005 Tedrick ..... E04H 4/084 4/498
2007/0256229 A1 * 11/2007 Duarte ..... E04H 4/084 4/498

(Continued)

FOREIGN PATENT DOCUMENTS

FR 2966858 * 3/2017 ..... E04H 4/084

*Primary Examiner* — David P Angwin
*Assistant Examiner* — Nicholas A Ros
(74) *Attorney, Agent, or Firm* — FisherBroyles, LLP

(57) ABSTRACT

A spa cover lifting system is provided for selectively removing and replacing the cover of a spa. The spa cover lifter system has a frame configured to hold a cover of the spa and an actuator coupled to the frame. Selective actuation of the actuator by a user causes at least a portion of the frame and the cover to rotate about and between a first, closed position, in which access to the water of the spa is restricted, and a second, open position, in which access to the water of the spa is not restricted. The actuator and at least a portion of the frame are positioned below a deck that is around the outside of the spa so that the actuator and at least a portion of the frame are inaccessible to a user of the spa during normal usage.

20 Claims, 7 Drawing Sheets

(56) References Cited

U.S. PATENT DOCUMENTS

| | | | | |
|---|---|---|---|---|
| 2015/0184410 | A1* | 7/2015 | Flores | E04H 4/084<br>4/498 |
| 2018/0073263 | A1* | 3/2018 | Kadlecova | B63B 19/19 |
| 2018/0230705 | A1* | 8/2018 | Spicer | E04H 4/084 |

* cited by examiner

SPA COVER LIFTER SYSTEM AND METHOD

CROSS-REFERENCE TO RELATED PATENT APPLICATIONS

This application claims the benefit of U.S. Provisional Application No. 62/316,471, filed on Mar. 31, 2016 which is herein incorporated by reference in its entirety.

FIELD OF THE INVENTION

The present invention relates generally to a spa cover lifter system and method. More specifically, the invention pertains to systems and methods for selectively moving a spa cover between an open position, in which the cover is lifted off of the spa and a closed position in which the spa is covered by the cover.

BACKGROUND OF THE INVENTION

Spa covers are conventionally used to cover the open end of a spa or whirlpool to prevent people or foreign objects such as debris from falling into the water of the spa when the spa is not in use. The spa cover also is conventionally used to insulate the water of spa to reduce the loss of heat from the water.

Conventional spa covers can be bulky and can have a thick construction to provide insulating properties and save energy by retaining heat in the water of the spa. Further, because spas can be relatively large, the spa cover required to cover a large spa can be quite large. Thus, conventional spa covers can be heavy and difficult for an individual to manually remove from the opening of the spa prior to use or to replace over the spa after use. Difficulty in removing the spa cover can be particularly problematic for users who have limited strength and/or mobility. Improperly moving the spa cover from the opening of the spa or storage of the spa cover can result in damage to the spa cover and/or the spa.

Accordingly, it is desirable for users to have a spa cover lifter to automatically remove the spa cover and position the spa cover in a convenient open position so that the user has access to the water of the spa. Further it is desirable for the spa cover lifter to automatically return the spa cover to a closed position to cover the opening of the spa when the user has completed use of the spa.

SUMMARY

Presented herein is a spa cover lifting system for selectively removing and replacing the cover of a spa. In one aspect, the spa cover lifter system comprises a frame and an actuator coupled to the frame. The frame can be configured to hold a cover of a spa. Selective actuation of the actuator by a user can cause at least a portion of the frame and the cover to rotate about and between a first, closed position, in which access to the water of the spa is restricted, and a second, open position, in which access to the water of the spa is not restricted. In one aspect, in the first, closed position, the cover can be substantially horizontal relative to a support surface upon which the spa rests, and in the second, open position, the cover can be substantially vertical relative to the support surface. The actuator and at least a portion of the frame can be positioned below a deck that is positioned outside of the spa so that the actuator and at least a portion of the frame are inaccessible to a user of the spa during normal usage.

The frame can be a rigid frame configured to engage and support the cover. In one aspect, the frame comprises at least one of a carriage, at least one support member and at least one attachment arm. The carriage can be sized and shaped to substantially correspond to the shape of the cover of the spa so that the carriage can be coupled to the cover of the spa. In another aspect, the support member can be rotatably coupled to a mount. At least a portion of the carriage, the support member and the attachment arm can be fixedly attached together so that rotation and/or movement of the attachment arm causes rotation and/or movement of the carriage and the support member.

The actuator can comprise a mechanical system configured to induce movement such as a hydraulic system, a pneumatic system, a system of rods and cables and the like. A first portion of the actuator can be fixedly attached to the support surface or other non-movable surface, and a second portion of the actuator can be coupled to the attachment arm of the frame. For example, if the actuator is a hydraulic system, a first end of a hydraulic cylinder can be secured to a floor supporting the spa, and a second end of the hydraulic cylinder can be coupled to the attachment arm.

In use, a user can actuate the actuator with a controller. Upon actuation, the actuator can exert a force on the attachment arm which can cause the attachment arm, the support member and the carriage to rotate relative to the mount. If the cover of the spa is closed, actuation of the system can cause the frame and cover to rotate in a first direction from the first, closed position, in which the cover can overlie at least a portion of the spa to the second, open position in which the cover does not overlie the perimeter wall of the spa. If the cover of the spa is open, actuation of the system can cause the frame and cover to rotate in a second direction from the second, open position toward the first, closed position.

Related methods of operation are also provided. Other apparatuses, methods, systems, features, and advantages of the spa cover lifter system will be or become apparent to one with skill in the art upon examination of the following figures and detailed description. It is intended that all such additional apparatuses, methods, systems, features, and advantages be included within this description, be within the scope of the spa cover lifter system, and be protected by the accompanying claims.

DESCRIPTION OF THE INVENTION

Figure 1:
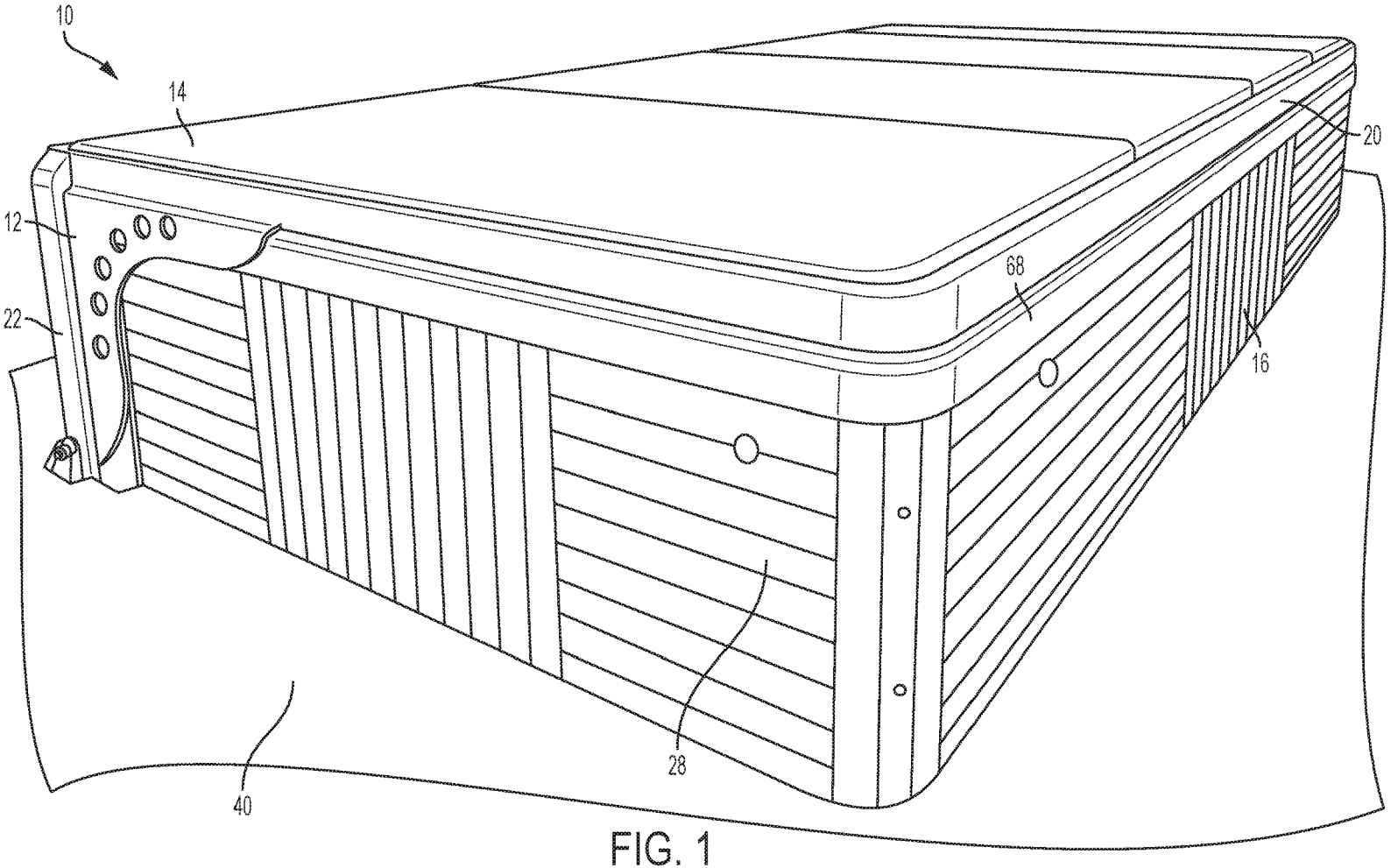
FIG. 1 is a front perspective view of the spa cover lifter system of the present application, showing a spa, a spa cover lifter and a cover in a closed position, according to one aspect.
Figure 2:
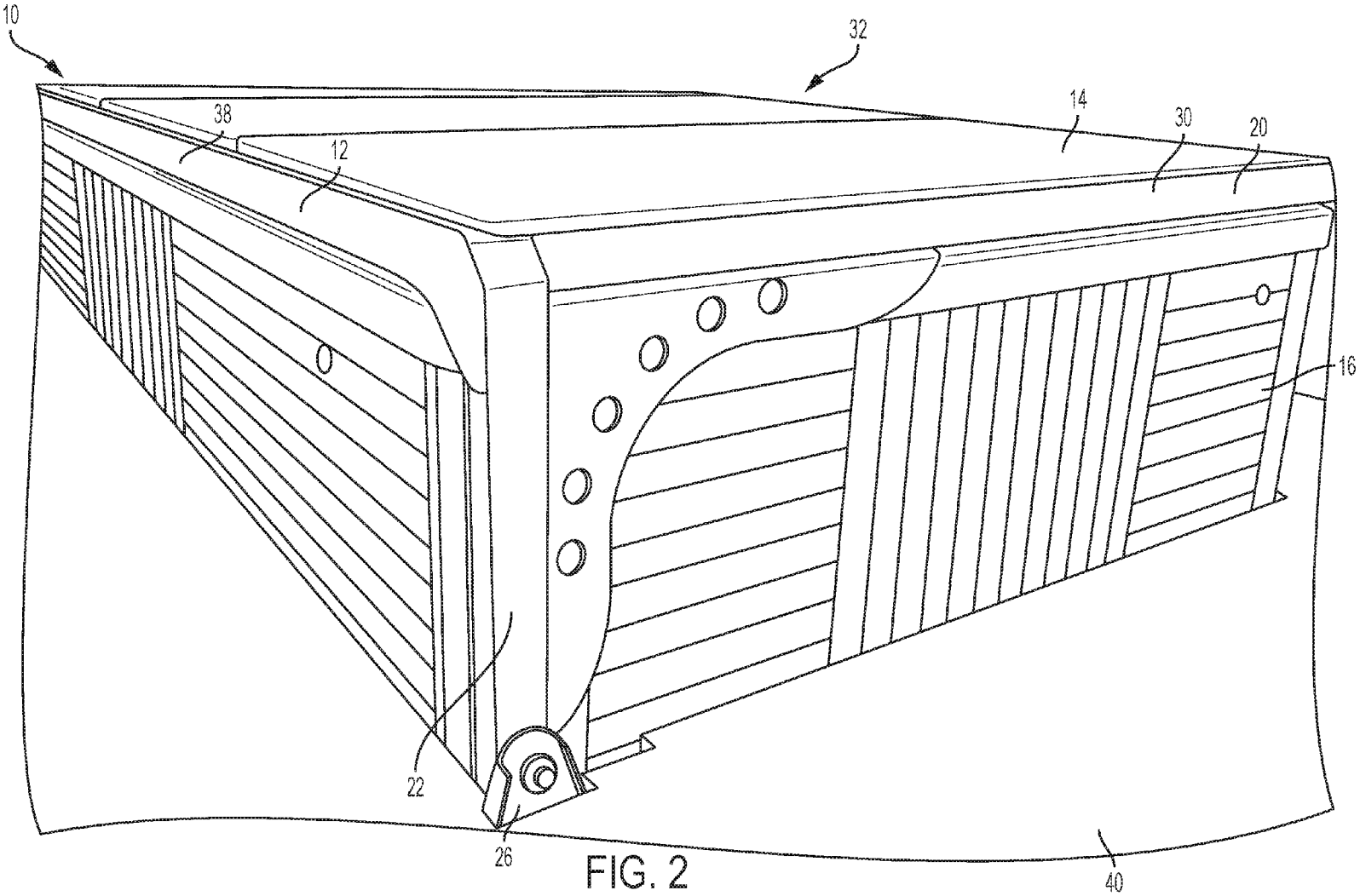
FIG. 2 is a rear perspective view of the spa cover lifter system of FIG. 1 in the closed position.
Figure 3:
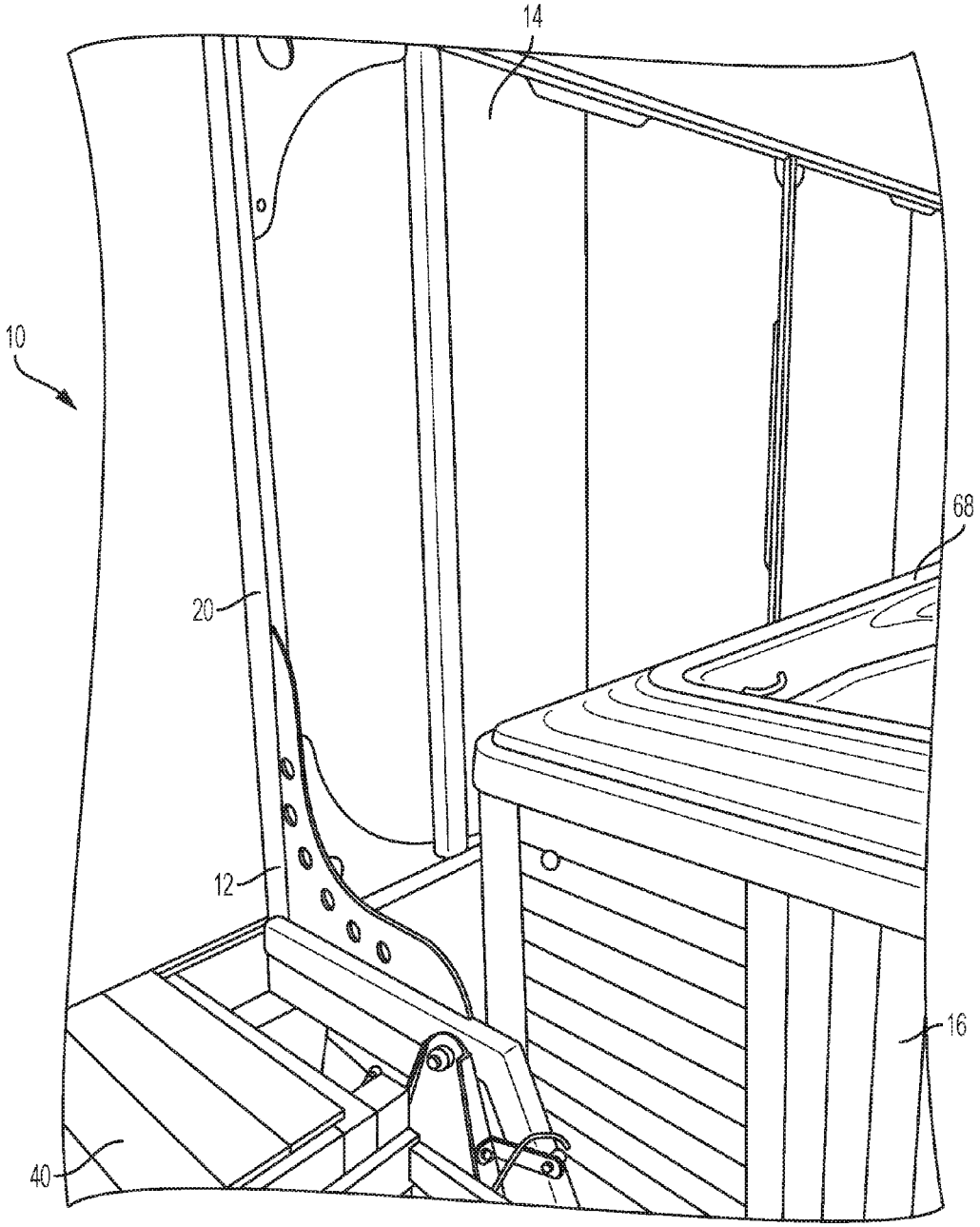
FIG. 3 is a perspective view of the spa cover lifter system of FIG. 1 in an open position. Note that portions of a deck around the spa have been removed only to show portions of the spa cover lifter system positioned below the deck.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to an "element" includes aspects having two or more such elements unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The application relates to spa cover lifting systems and methods for removing and replacing the cover of a spa. In one aspect, and as illustrated in FIGS. 1-7, the spa cover lifter system 10 can comprise at least a frame 12 configured to hold a cover 14 of a spa 16 and an actuator 18 configured to selectively rotate at least a portion of the frame and the cover. For example, at least a portion of the cover 14 can be attached to and/or positioned in the frame 12, so that as the frame rotates relative to the spa, the cover is rotated relative to the spa 16 as well.

Figure 7:
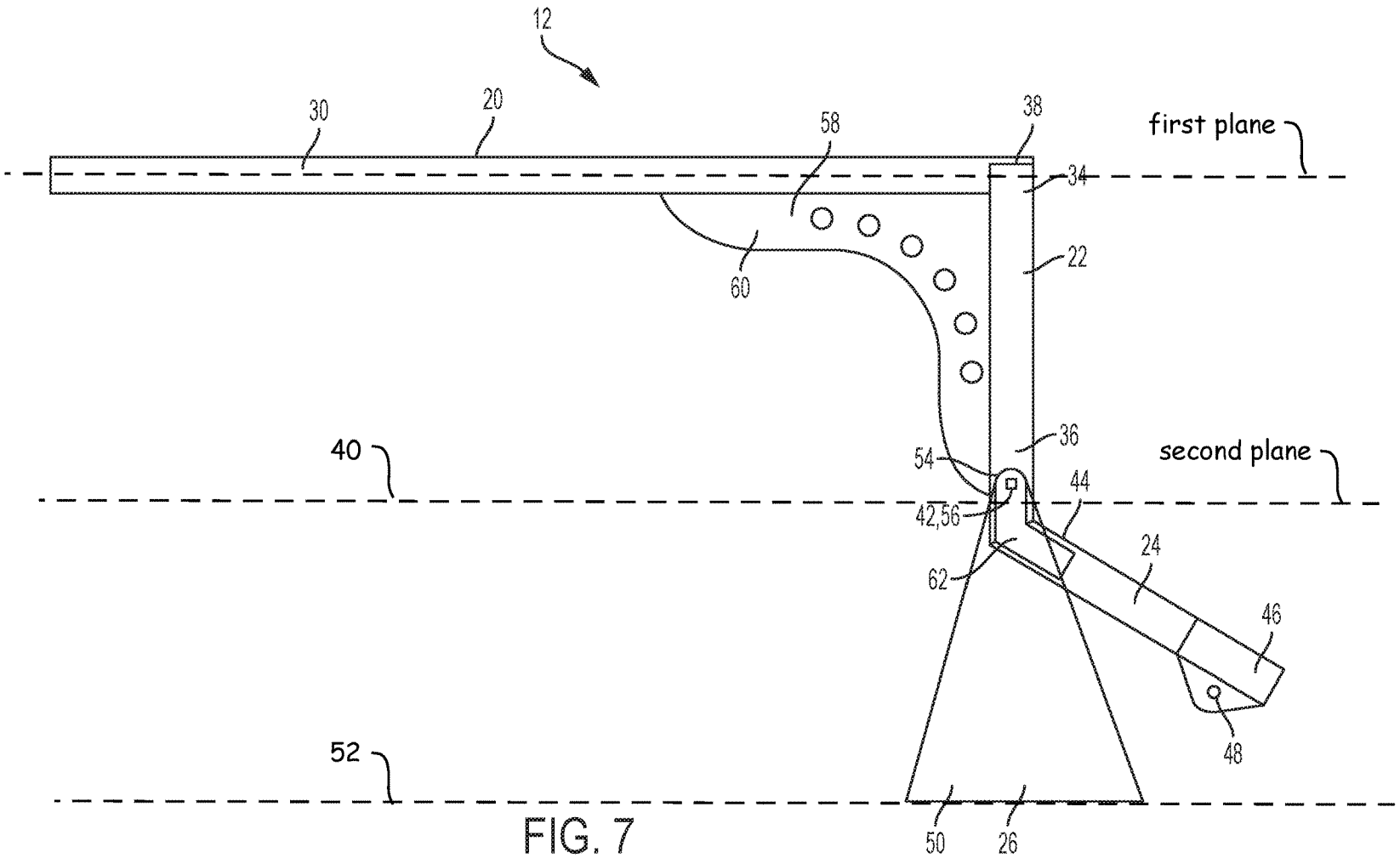
FIG. 7 is a side elevational view of a frame of the spa cover lifter system of FIG. 1.

The frame 12 is illustrated in more detail in FIG. 7. In one aspect, the frame comprises at least one of a carriage 20, at least one support member 22, at least one attachment arm 24 and at least one mount 26. In another aspect, at least a portion of the frame can be formed from a rigid material, such as aluminum, steel, wood and the like so that the frame can provide structural support to the cover 14.

In one aspect, the carriage 20 can be sized and shaped to correspond to the size and shape of the cover 14 and/or the spa 16. For example, the carriage can be sized and shaped to conform to the size of the cover so that the cover can be positioned in and/or mounted to the carriage 20. Optionally, the carriage can be sized and shaped to conform to the size of the spa so that in a closed position, as described more fully below, the carriage 20 can overlie at least a portion of a perimeter wall 28 of the spa 16. For example, when viewed from above, the carriage can be substantially square, substantially rectangular, substantially circular, or any other shape contemplated.

In one aspect, the carriage 20 can comprise at least one carriage portion 30 coupled together or formed monolithically that cooperate to define a carriage opening 32 sized and shaped to hold the cover 14. For example, if the spa 16 is rectangular, the at least one carriage portion 30 can comprise four carriage portions welded together in a rectangular shape to define a rectangular carriage opening. In another example, if the spa is substantially circular, the at least one carriage portion can comprise a single carriage portion formed to define a substantially circular carriage opening 32. In another aspect, a channel can be defined in a portion of the carriage 20 so that a portion of the cover can slide into the channel and secure the cover 14 to the carriage.

The at least one support member 22 can be a rigid, substantially linear member having a proximal end 34 and a distal end 36, according to one aspect. The proximal end of the at least one support member can be coupled to a portion of the carriage 20. For example, the proximal end 34 of the support member 22 can be welded to a back carriage portion 38 that, when assembled, is positioned on a back side of the spa 16. In another aspect, the at least one support member can extend away from the carriage 20 at a predetermined angle. For example, the support member 22 can extend away from the carriage at substantially a right angle, as illustrated in the figures. Optionally, however, the support member can extend away from the carriage 20 at an acute angle. In another aspect, the at least one support member 22 can have a length corresponding to a height of the spa 16. Optionally, the at least one support member can have a length corresponding to a height of a portion of the spa that is above a deck 40 positioned around the spa 16. For example, the length of the support member can be selected so that when the proximal end 34 of the support member 22 is coupled to the carriage, the distal end 36 of the support member is positioned below the deck positioned around the spa (i.e., so that the distal end of the support member 22 is hidden from view). In another aspect, at least one support member bore 42 can be defined in the distal end or adjacent to the distal end 36 of the support member.

The at least one attachment arm 24 can be a rigid, substantially linear arm having a proximal end 44 and a distal end 46, according to one aspect. The proximal end of the at least one attachment arm 24 can be coupled to a portion of the distal end 36 of the at least one support member 22. In another aspect, the at least one attachment arm 24 can extend away from the support member at a predetermined angle. For example, the attachment arm can extend away from the support member 22 at substantially a right angle. Optionally, however, the attachment arm 24 can extend away from the support member at an obtuse angle, as illustrated in FIG. 7. In this example, the attachment arm can extend away from the mount 26 at an angle of about 10 degrees, about 20 degrees, about 30 degrees, about 40 degrees, about 45 degrees, about 50 degrees, about 60 degrees, about 70 degrees, about 80 degrees or greater than about 80 degrees. In another aspect, the at least one attachment arm 24 can have a length corresponding to the length of the support member. For example, the length of the attachment arm and the length of the support member 22 can be substantially the same. In another example, the length of the at least one attachment arm 24 can be less than or greater than the length of the support member. In this example, the length of the attachment arm relative to the length of the support member 22 can be ±about 1%, about 2%, about 3%, about 4%, about 5%, about 10%, about 20%, about 30%, about 40%, about 50%, about 60%, about 70%, about 80%, about 90%, about 100% or greater than about 100%. In another aspect, at least one attachment bore 48 can be defined in the distal end or adjacent to the distal end 46 of the attachment arm 24.

The at least one mount 26 can be a rigid support member configured to support at least a portion the frame 12 and the cover 14. In one aspect, the mount can have a distal end 50 configured to be positioned on a support surface 52 upon which the spa 16 rests, and an opposed proximal end 54. In another aspect, the height of the mount 26 (that is, the distance between the distal end and the proximal end of the mount) can be selected so that the proximal end of the mount is positioned at substantially the same level as the deck 40 positioned around the spa. Optionally, the height of the mount 26 can be selected so that the proximal end 54 of the mount is positioned slightly above or slightly below the level of the deck positioned around the spa 16. At least one mounting bore 56 can be defined in a portion of the proximal end or adjacent to the proximal end 54 of the mount 26.

In one aspect, at least one brace 58 can be provided to hold at least a portion of the elements of the frame 12 in their respective positions. For example, a first brace 60 can be positioned between the carriage 20 and the at least one support member 22 so that the carriage does not move relative to the support member. In another example, a second brace 62 can be positioned between the support member 22 and the at least one attachment arm 24 so that the support member does not move relative to the attachment arm.

In one aspect, the deck 40 can be positioned around at least a portion of the perimeter wall 28 of the spa 16. In another aspect, the deck can be spaced from the support surface 52 upon which the spa rests a predetermined distance. For example, the deck can be 1 foot, 2 feet, 3 feet, 4 feet or any distance in between above the support surface upon which the spa rests. In a further aspect, at least a portion of the deck 40 and at least a portion of the support surface 52 can be substantially planar. In still another aspect, at least a portion of the deck and at least a portion of the support surface can be substantially parallel to each other. In a further aspect, the deck 40 can be any type of surface such as a conventional deck formed from spaced planks, and a solid surface such as that formed from sheets of wood or tiles and the like.

The actuator 18 can comprise a controller and a mechanical system for inducing movement, such as a hydraulic system, a pneumatic system, a linkage system of rods, cables, pulleys, a motor and the like. For example, if the actuator comprises a hydraulic system 64, a hydraulic cylinder 66 can be coupled to the at least one attachment arm 24 so that actuation of the hydraulic cylinder causes the attachment arm to move. As can be appreciated, the hydraulic system can further comprise a pump, hoses and the like. In another example, if the actuator comprises a linkage system, a cable, chain, rod and the like can be coupled to the at least one attachment arm 24 so that tension exerted on the cable, chain or rod by the motor can cause the attachment arm to move.

To assemble the spa cover lifter system 10, the at least one support member 22 can be rotatably coupled to the at least one mount 26. For example, the mounting bore 56 of the mount and the support member bore 42 of the support member can be co-axially aligned so that a pin and the like can be inserted through the aligned bores. With the pin inserted through the aligned bores, the carriage 20, the support member 22 and the attachment arm 24 can be rotatable about and between a first, closed position, in which the carriage can overlie at least a portion of the perimeter wall 28 of the spa 16 and a second, open position in which the carriage 20 does not overlie the perimeter wall of the spa. That is, in the second, open position, the carriage can be offset from an upper edge 68 of the perimeter wall 28.

Figure 4:
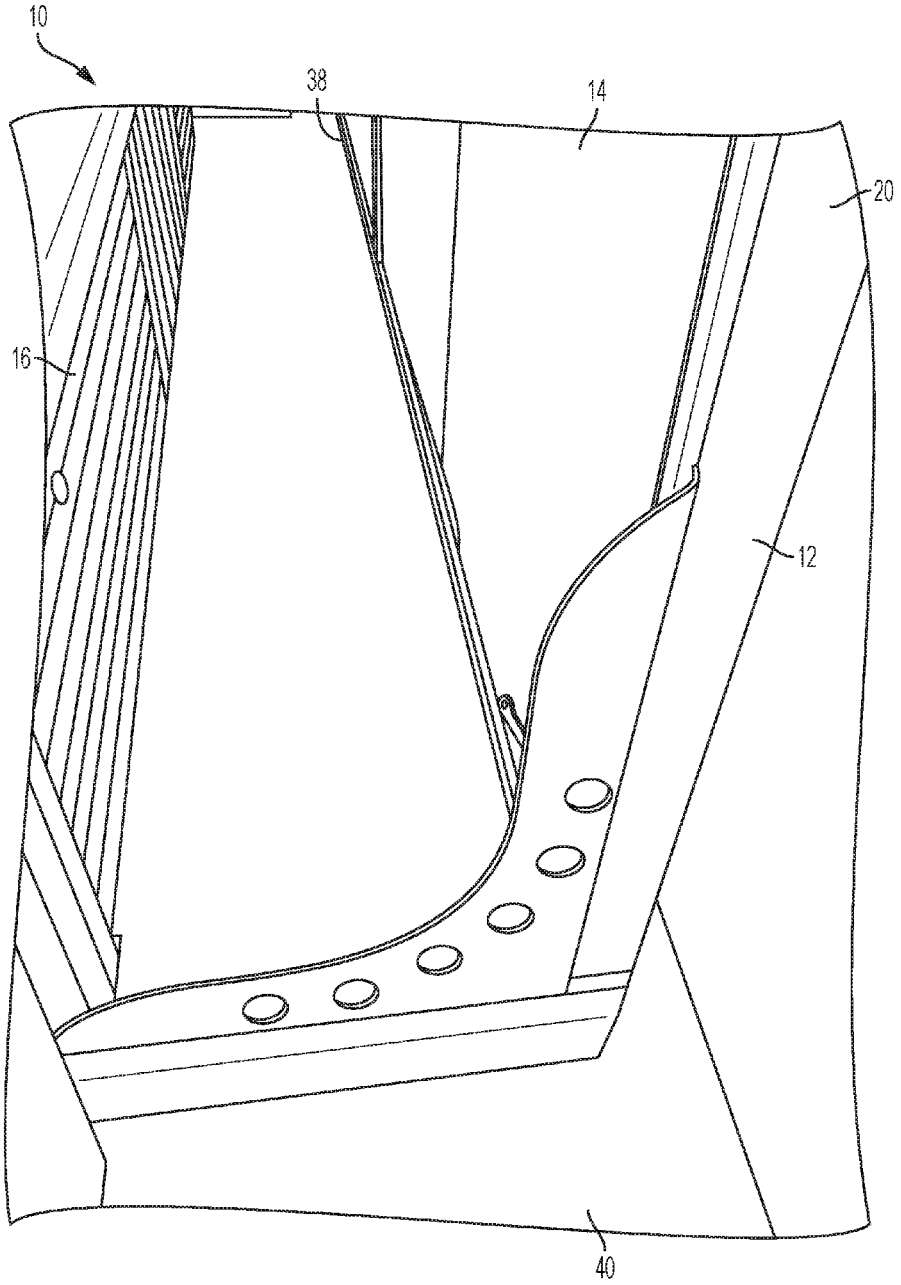
FIG. 4 is a perspective view of the spa cover lifter system of FIG. 1 in the open position.
Figure 5:
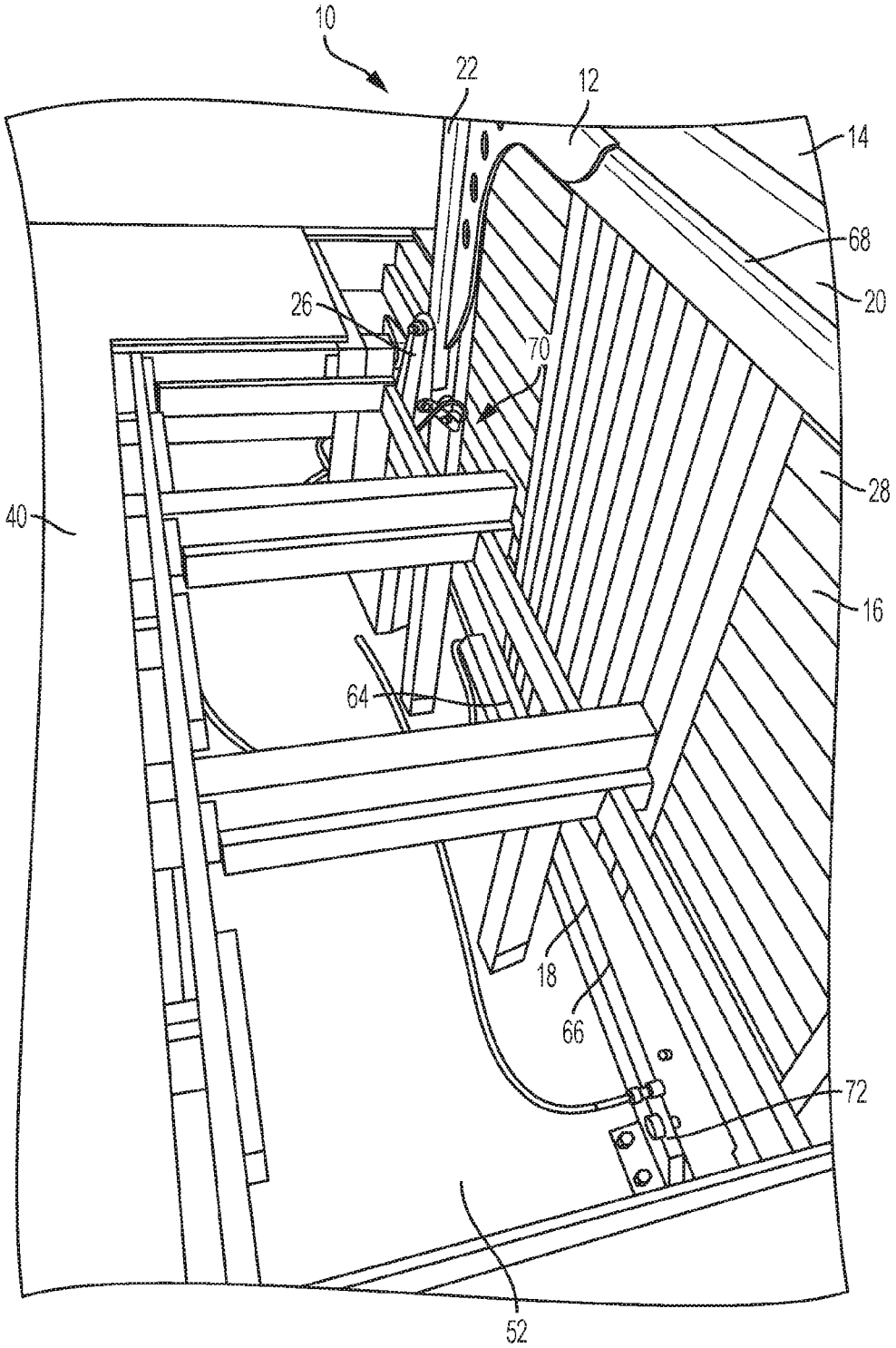
FIG. 5 is a perspective view of the spa cover lifter system of FIG. 1 in the closed position. Note that portions of the deck around the spa have been removed only to show an actuator of the spa cover lifter system positioned below the deck.
Figure 6:
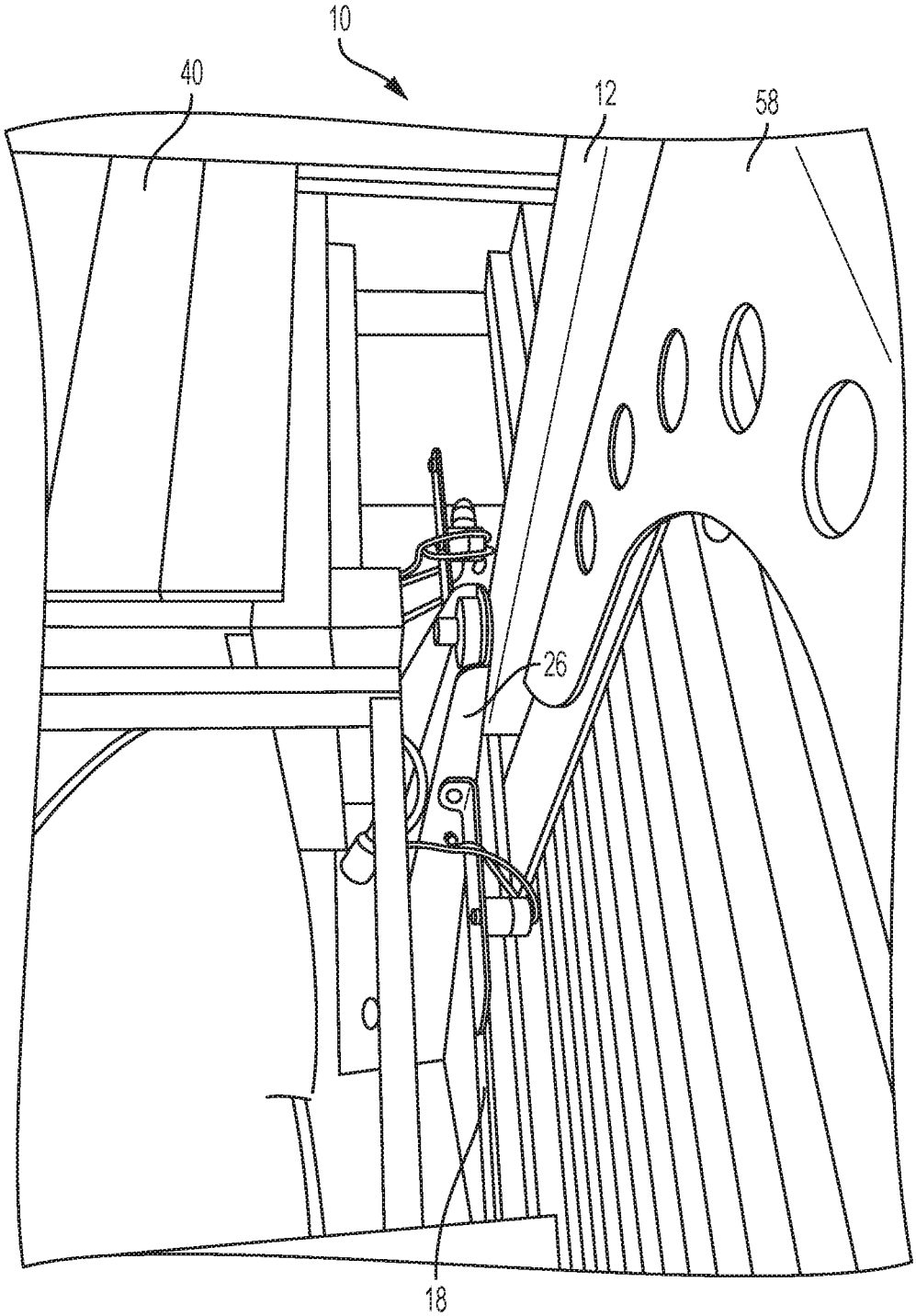
FIG. 6 is a perspective view of the spa cover lifter system of FIG. 1 in the closed position. Note that portions of the deck around the spa have been removed only to show an actuator of the spa cover lifter system positioned below the deck.

In another aspect, the second, open position of the carriage 20 can be about ninety degrees relative to the first, closed position. For example, if in the first, closed position, the carriage is substantially horizontal or parallel to the upper edge 68 of the perimeter wall 28 of the spa 16, in the second open position, the carriage can be substantially vertical or substantially normal to the upper edge of the perimeter wall of the spa. In another example, if in the first, closed position, the carriage is substantially horizontal or parallel to the support surface 52, in the second open position, the carriage can be substantially vertical or substantially normal to the support surface. It is contemplated that the second, open position of the carriage can be more or less than ninety degrees relative to the first, closed position. For example, the second, open position can be about 10 degrees, about 20 degrees, about 30 degrees, about 40 degrees, about 45 degrees, about 50 degrees, about 60 degrees, about 70 degrees, about 80 degrees, about 100 degrees, about 110 degrees, about 120 degrees, about 130 degrees, about 140 degrees, about 145 degrees, about 150 degrees, about 160 degrees, about 170 degrees, about 180 and greater than about 180 degrees relative to the first, closed position. As illustrated in FIG. 4, in the second, open position, the back carriage portion 38 can be positioned substantially on the deck 40 around the spa 16.

In one aspect, the at least one mount 26 can be securedly attached to the support surface 52. For example, the at least one mount can be bolted to the floor supporting the spa 16. In another aspect, at least a portion of the actuator 18 can be securedly attached to the support surface. For example, a first end 70 of the hydraulic cylinder 66 can be coupled to the attachment arm 24 and a second end 72 of the hydraulic cylinder can be bolted to the support surface 52 supporting the spa 16. The deck 40 can be positioned around the spa so that all elements of the actuator (except for the controller) can be positioned below the deck. That is, any hydraulic system 64, pneumatic system and linkage system of the actuator 18 can be hidden from view during operation of the spa cover lifter system 10.

In one aspect, the spa cover 14 can be securedly positioned in the carriage opening 32 of the carriage 20. For example, if a channel is defined in a portion of the carriage, an outer wall of the spa cover can slide into the channel to secure the spa cover 14 to the carriage. In another aspect, the spa cover can be coupled to the carriage 20 with adhesives, hook and loop fasteners and the like so that the spa cover 14 substantially covers or fills the carriage opening.

In use, the spa cover lifter system 10 can be in the first, closed position, in which the carriage 20 overlies at least a portion of the perimeter wall 28 of the spa 16. In the first, closed position, the spa cover 14 can overlie the opening of the spa so that the water in the spa 16 is substantially covered. When a user desires to use the spa, the user can use the controller to actuate the actuator 18. Upon actuation, the actuator can exert a force on the at least one attachment arm 24 which causes the carriage 20, the support member 22 and the attachment arm to rotate in a first direction relative to the mount 26. For example, if the actuator is a hydraulic system 64, actuation of the system can cause the first end 70 of the hydraulic cylinder 66 to move closer to the second end 72 of the hydraulic cylinder. Correspondingly, this can cause the distal end 46 of the at least one attachment arm 24 to move closer to the second end of the hydraulic cylinder, which causes the at least one support member 22 and the carriage 20 to rotate in the first direction relative to the mount 26. As the carriage rotates in the first direction, the spa cover 14 can rotate up and away from the perimeter wall 28 of the spa 16. This rotation can continue until the spa cover lifter system 10 reaches the second, open position in which the carriage 20 does not overlie the perimeter wall of the spa. In the second, open position, the spa cover 14 does not overlie the opening of the spa 16 so that the water in the spa is not covered and the user can access the water in the spa 16. In one aspect, sensors can be provided to stop rotation of the frame 12 in the first direction upon reaching a predetermined point. For example, a photosensor, a proximity sensor and the like can be provided to prevent over and/or undesired rotation of the frame.

When a user desires to close the spa 16, the user can use the control to actuate the actuator 18. Upon actuation, the actuator can exert a force on the at least one attachment arm 24 which causes the carriage 20, the support member 22 and the attachment arm to rotate in a second direction relative to the mount 26 that is opposed to the first direction. For example, if the actuator 18 is a hydraulic system 64, actuation of the system to close the cover 14 can cause the first end 70 of the hydraulic cylinder 66 to move away from the second end 72 of the hydraulic cylinder. Correspondingly, this can cause the distal end 46 of the at least one attachment arm to move away from the second end of the hydraulic cylinder 66, which causes the at least one support member 22 and the carriage 20 to rotate in the second direction relative to the mount 26. As the carriage rotates in the second direction, the spa cover 14 can rotate down and toward the perimeter wall 28 of the spa 16. This rotation can continue until the spa cover lifter system reaches the first, closed position and the spa cover 14 overlies the opening of the spa so that the water in the spa 16 is covered and the user cannot access the water in the spa. In one aspect, sensors can be provided to stop rotation of the frame 12 in the second direction upon reaching a predetermined point. For example, a photosensor, a proximity sensor and the like can be provided to stop the actuator when the spa cover overlies the opening of the spa.

As can be seen in the figures, the spa cover 14, the carriage 20 and the support member 22 can be the only portions of the spa cover lifter system 10 positioned above the deck 40 around the spa 16. In some aspects, the proximal end 54 of the mount 26 can also be positioned above the deck. Optionally, in other aspects, a portion of the attachment arm 24 can be positioned above the deck 40 when the system is in the second, open position. Correspondingly, the actuator 18 and at least a portion of the attachment arm can be positioned below the deck regardless of whether the system is in the first, open position or the second, closed position. Thus, as the carriage 20 is rotated about and between the first, closed position and the second, open position, potentially dangerous and/or unsightly portions of the actuator can be separated from the user of the spa. For example, cables, hydraulic cylinders 66 and the like can be positioned below the deck 40 and are inaccessible to the user during normal use of the system.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

What is claimed is:

1. A spa cover lifting system for selectively removing and replacing the cover of a spa positioned on a support surface, the system comprising:

a frame configured to hold the cover of the spa;

wherein the frame, in a closed position, defines a first plane parallel to and above a second plane defined by a deck around a base of the spa;

a support member fixedly, non-rotatably extends from a back carriage portion of the frame and, in the closed position, extends toward the support surface and has a preselected length that positions a distal end of the support member below the second plane;

an elongate attachment arm fixedly, non-rotatably extends from the support member at a right angle or at an obtuse angle relative to the support member;

wherein, in the closed position, the attachment arm extends in a direction away from the cover of the spa at a position below the second plane, wherein the attachment arm has a free end opposite the support member; and an actuator coupled to the free end of the attachment arm and configured to selectively rotate the frame and the cover between the closed position, in which access to the water of the spa is restricted by the cover, and an open position, in which access to the water of the spa is not restricted by the cover.

2. The spa cover lifting system of claim 1, wherein the attachment arm is oriented at a right angle relative to the support member.

3. The spa cover lifting system of claim 1, wherein the attachment arm is oriented at an obtuse angle relative to the support member.

4. The spa cover lifting system of claim 1, wherein the system further comprises a deck positioned around at least a portion of a perimeter wall of the spa, wherein the deck is spaced from the support surface a predetermined distance and wherein the actuator is positioned below the deck.

5. The spa cover lifting system of claim 4, wherein at least a portion of the frame is positioned below the deck.

6. The spa cover lifting system of claim 4, wherein, in the open position, a portion of the frame is positioned substantially on the deck.

7. The spa cover lifting system of claim 1, wherein in the closed position, the cover is horizontal relative to the support surface and wherein in the open position, the cover is vertical relative to the support surface.

8. The spa cover lifting system of claim 7, wherein the deck is positioned around at least a portion of a perimeter wall of the spa, and wherein the deck is spaced from the support surface a predetermined distance.

9. The spa cover lifting system of claim 8, wherein the free end of the attachment arm is positioned below the deck.

10. The spa cover lifting system of claim 8, wherein the frame further comprises at least one mount configured to support at least a portion of the frame and the cover, wherein the mount has a proximal end, and an opposed distal end configured to be positioned on the support surface.

11. The spa cover lifting system of claim 10, wherein the attachment arm and the support member are rotatably coupled to the mount for rotation relative to the mount.

12. The spa cover lifting system of claim 10, wherein the proximal end of the mount is positioned below the level of the deck.

13. The spa cover lifting system of claim 10, wherein the proximal end of the mount is positioned adjacent to the level of the deck.

14. The spa cover lifting system of claim 8, wherein the actuator is positioned between the deck and the support surface.

15. The spa cover lifting system of claim 14, wherein the frame comprises a carriage sized and shaped to correspond to the size and shape of the cover, and wherein the carriage comprises a plurality of carriage portions coupled together that cooperate to define a carriage opening sized and shaped to hold the cover.

16. The spa cover lifting system of claim 15, wherein in the open position, the back carriage portion is positioned substantially on the deck.

17. A method of automatically, selectively covering a spa positioned on a support surface, the method comprising:

providing a spa cover lifting system comprising:

a frame configured to hold the cover of the spa;

wherein the frame, in a closed position, defines a first plane parallel to and above a second plane defined by a deck around a base of the spa;

a support member fixedly, non-rotatably extends from a back carriage portion of the frame and, in the closed position, extends towards the support surface and has a preselected length that positions a distal end of the support member below the second plane;

an elongate attachment arm fixedly, non-rotatably extends from the support member at a right angle or at an obtuse angle relative to the support member;

wherein, in the closed position, the attachment arm extends in a direction away from the cover of the spa at a position below the second plane, wherein the attachment arm has a free end opposite the support member; and an actuator coupled to the free end of the attachment arm and configured to selectively rotate the frame and the cover between the closed position, in which access to the water of the spa is restricted by the cover, and an open position, in which access to the water of the spa is not restricted by the cover and actuating the actuator to rotate the cover to the first, closed position.

18. The method of claim 17, wherein in the closed position, the cover is substantially horizontal relative to the support surface and wherein in the open position, the cover is substantially vertical relative to the support surface.

19. The method of claim 17, wherein the deck is positioned around at least a portion of a perimeter wall of the spa, wherein the deck is spaced from the support surface a predetermined distance and wherein the actuator is positioned below the deck.

20. The method of claim 19, wherein at least a portion of the frame is positioned below the deck.

* * * * *